US010029469B2

(12) United States Patent
Mori

(10) Patent No.: US 10,029,469 B2
(45) Date of Patent: Jul. 24, 2018

(54) RECORDING APPARATUS WITH AN ENHANCED MEDIUM SUPPORT STRUCTURE

(71) Applicant: SEIKO EPSON CORPORATION, Tokyo (JP)

(72) Inventor: Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/460,021

(22) Filed: Mar. 15, 2017

(65) Prior Publication Data

US 2017/0266975 A1 Sep. 21, 2017

(30) Foreign Application Priority Data

Mar. 18, 2016 (JP) ..... 2016-054961

(51) Int. Cl.
*B41J 2/165* (2006.01)
*B41J 11/06* (2006.01)

(52) U.S. Cl.
CPC ..... *B41J 2/16526* (2013.01); *B41J 2/16585* (2013.01); *B41J 11/06* (2013.01)

(58) Field of Classification Search
CPC ..... B41J 2/1433; B41J 2/16517
See application file for complete search history.

(56) References Cited

U.S. PATENT DOCUMENTS

2003/0030692 A1* 2/2003 Uchida ..... B41J 2/1721 347/35
2003/0227514 A1* 12/2003 Nakashima ..... B41J 2/16585 347/42
2004/0104961 A1* 6/2004 Hashi ..... B41J 2/16544 347/29
2005/0093919 A1* 5/2005 Takatsuka ..... B41J 2/16523 347/30
2013/0307901 A1* 11/2013 Takahashi ..... B41J 2/16547 347/33
2017/0266966 A1 9/2017 Mori

FOREIGN PATENT DOCUMENTS

JP 2001-071521 3/2001
JP 2004-009667 1/2004
JP 2017165055 A 9/2017

* cited by examiner

*Primary Examiner* — Bradley Thies
(74) *Attorney, Agent, or Firm* — Workman Nydegger

(57) ABSTRACT

A recording apparatus includes a supporting portion that supports a sheet of paper transported and a recording head fixedly disposed at a position opposing the supporting portion, for recording. The recording head has nozzle rows for ejecting ink, and the nozzle rows are arranged side by side in the recording head in a direction intersecting a transport direction of the sheet. The supporting portion has a dumping portion including a position opposite the nozzle rows of the recording head, and the dumping portion is capable of receiving the ink ejected from the nozzle rows when the recording head performs flushing. The supporting portion has a supporting surface capable of supporting the sheet at a position not opposite the nozzle rows of the recording head. A slope inclining relative to the supporting surface is disposed in at least part of the boundary region between the dumping portion and the supporting surface.

9 Claims, 15 Drawing Sheets

RECORDING APPARATUS WITH AN ENHANCED MEDIUM SUPPORT STRUCTURE

CROSS REFERENCES TO RELATED APPLICATIONS

The entire disclosure of Japanese Patent Application No. 2016-054961, filed Mar. 18, 2016 is expressly incorporated by reference herein.

BACKGROUND

1. Technical Field

The present invention relates to recording apparatuses such as, for example, ink jet printers.

2. Related Art

There is known an ink jet printer, which is a type of recording apparatus, having a head fixedly disposed at a position opposite a supporting portion that supports a sheet of paper, which is an example of a medium. The head has a plurality of nozzles that eject ink, which is an example of liquid, to record on the sheet of paper transported over the supporting portion. This type of printer is desired to perform "flushing" to discharge the ink inside the nozzles as needed in order to maintain and recover ink ejecting properties of the nozzles in the head. JP-A-2004-9667 describes a printer that has a head including a plurality of nozzle groups, each of which has a plurality of nozzles, and a supporting portion provided at a position opposite the head. In the supporting portion, a sheet of paper is supported by a plurality of protrusions that are disposed at positions opposite the spacings between the nozzle groups disposed in the head. This printer performs flushing by ejecting ink toward the regions on the supporting portion that are opposite the nozzle groups of the head, that is, the regions that are provided between the protrusions on the supporting portion.

However, the printer described in JP-A-2004-9667 may not stably maintain the position of the sheet transported over the supporting portion because the sheet is supported by the supporting portion only with the portions (the protrusions) opposite the spacings between the nozzle groups provided in the head. A tilted or warped sheet on the supporting portion results in the deviation of landing positions on the sheet by the ink ejected from the nozzles of the head. This may affect recording quality.

SUMMARY

An advantage of some aspects of the invention is that a recording apparatus capable of securing flatness of a medium supported by a supporting portion that allows a recording head for ejecting liquid to perform flushing is provided.

Advantageous effects will be described. According to an aspect of the invention, a recording apparatus includes a supporting portion that supports a medium transported and includes a recording head that is fixedly disposed at a position opposing the supporting portion and records by using liquid on the medium supported by the supporting portion. The recording head has a plurality of nozzle rows each including a plurality of nozzles that eject the liquid, and the plurality of nozzle rows are arranged side by side in the recording head along a width direction of the medium that intersects a transport direction of the medium. The supporting portion has a dumping portion including a position opposite the nozzle rows of the recording head, and the dumping portion is capable of receiving the liquid ejected from the nozzle rows when the recording head performs flushing. The supporting portion also has a supporting surface capable of supporting the medium at a position not opposite the nozzle rows of the recording head. The dumping portion has a slope disposed in at least part of a region adjoining the supporting surface, and the slope is disposed in continuity with the supporting surface and inclined upward toward the supporting surface.

With this configuration, even when part of the medium transported over the supporting surface of the supporting portion falls into the dumping portion, the medium can be supported by the slope provided in the dumping portion. In other words, even the positions in the supporting portion that are opposite the nozzle rows of the recording head can contribute to supporting of the medium. Thus, this configuration may stably obtain the flatness of the medium supported by the supporting portion that allows the recording head for ejecting liquid to perform flushing.

In the recording apparatus, it is preferable that the supporting surface be configured to include an upper surface of a protrusion protruding upward from the dumping portion and that the slope is provided at a position on the upstream side of the protrusion in the transport direction.

This configuration can reduce the likelihood of the front end of the transported medium being caught by the protrusion.

In the recording apparatus, it is preferable that the slope be also provided at a position on the downstream side of the protrusion in the transport direction.

With this configuration, even when the rear end of the medium transported falls into the dumping portion, the medium can be supported by the slope provided on the downstream side of the protrusion.

It is preferable that the recording apparatus further include a container for containing the liquid ejected from the nozzle rows when the recording head performs flushing. It is also preferable that the dumping portion has a through-hole for allowing the liquid to pass through toward the container.

With this configuration, the container contains the liquid ejected onto the dumping portion of the supporting portion, which allows the recording apparatus to be used continuously for a long time.

In the recording apparatus, it is preferable that the dumping portion include a groove for guiding the liquid ejected onto the slope to the container.

This configuration can facilitate the collection of the liquid ejected onto the slope.

In the recording apparatus, it is preferable that the groove be formed such that the width of the groove becomes smaller from the slope side of the groove toward the container side of the groove.

With this configuration, the capillary action of the grooves can further facilitate the collection of the liquid ejected onto the slope.

In the recording apparatus, it is preferable that the slope have a slit disposed at the upstream end of the slope in the transport direction. It is also preferable that the slit open more narrowly than the through-hole and be in communication with the container.

This configuration can facilitate the collection of the liquid ejected onto the slope.

In the recording apparatus, it is preferable that the recording head include a plurality of nozzle groups each having a plurality of the nozzle rows and the dumping portion is disposed separately at a position opposite each of the nozzle groups.

With this configuration, the liquid ejected onto the dumping portions can be collected via respective through-holes.

In the recording apparatus, it is preferable that the through-hole be provided in the dumping portion at a center thereof both in the transport direction and in the width direction.

With this configuration, liquid droplets or the like suspended in air can be collected efficiently in a configuration, for example, in which liquid is sucked by a pump or the like via the through-hole.

In the recording apparatus, it is preferable that the through-hole be provided at a position closer to the upstream side in the dumping portion in the transport direction and at the center of the dumping portion in the width direction.

This configuration can reduce the likelihood of the medium being caught by the dumping portion.

In the recording apparatus, it is preferable that at least the slope have water repellency in the supporting portion.

With this configuration, the water repellency of the slope allows the liquid ejected onto the slope by the flushing to flow swiftly, which can reduce a likelihood of the medium being stained when the transported medium comes into contact with the slope.

BRIEF DESCRIPTION OF THE DRAWINGS

The invention will be described with reference to the accompanying drawings, wherein like numbers reference like elements.

DESCRIPTION OF EXEMPLARY EMBODIMENTS

As a type of the recording apparatus according to the invention, an ink jet printer that records on a medium by using ink, which is an example of a liquid, will be described with reference to the drawings.

First Embodiment

Figure 1:
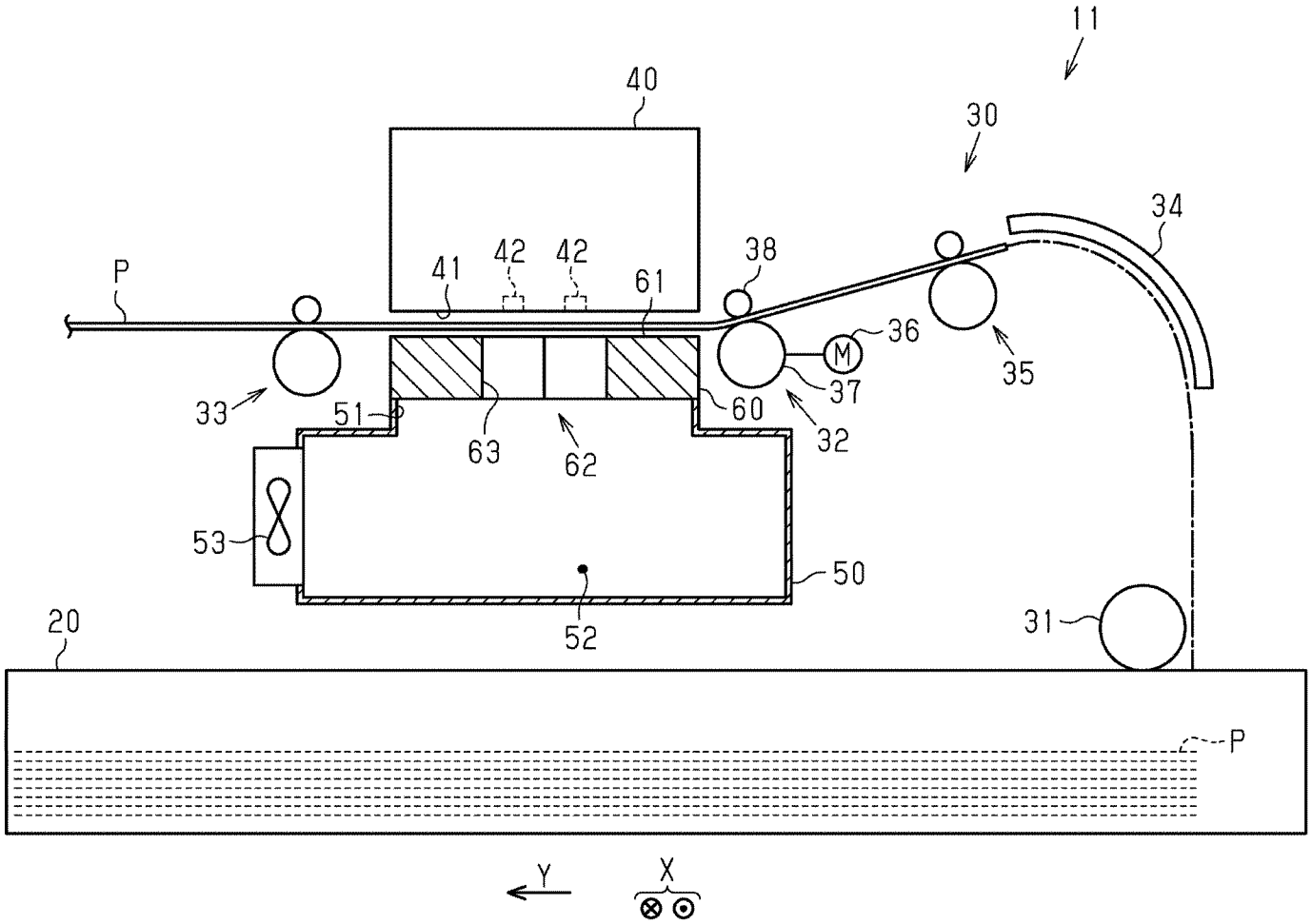
FIG. 1 is a side view schematically illustrating a recording apparatus according to a first embodiment of the invention.

As illustrated in FIG. 1, a recording apparatus 11 according to a first embodiment of the invention includes a paper cassette 20 capable of storing stacked sheets of paper P (otherwise referred to as "sheets P"), which is an example of a medium, a transport section 30 for transporting each sheet P contained in the paper cassette 20, a supporting portion 60 for supporting the sheet P transported by the transport section 30 from underneath the sheet P, and a recording head 40 for recording on the sheet P supported by the supporting portion 60. Note that a direction in which the sheet P is transported over the supporting portion 60 (i.e., a direction from the right side toward the left side of FIG. 1) is hereinafter referred to as the transport direction Y of the sheet P, and a direction intersecting the transport direction Y is referred to as the width direction X of the sheet P.

The transport section 30 includes a pickup roller 31 for sending out each sheet P that is located at the top-most position within the paper cassette 20, a pair of transport rollers 32 for transporting the sheet P sent out by the pickup roller 31 toward the supporting portion 60, and a pair of discharge rollers 33 for discharging the sheet P passing over the supporting portion 60. In other words, the pair of transport rollers 32 are provided on the upstream side of the supporting portion 60 in the transport direction Y and the pair of discharge rollers 33 are provided on the downstream side of the supporting portion 60. The transport section 30 further includes a guide 34 and a pair of intermediate rollers 35 provided at positions between the pickup roller 31 and the pair of transport rollers 32 in the transport path on which the sheet P is transported (the path indicated by the chain-dotted line in FIG. 1). In other words, the guide 34 guides the sheet P sent out by the pickup roller 31 toward the pair of intermediate rollers 35, and the pair of intermediate rollers 35 transport the sheet P having been guided by the guide 34 toward the pair of transport rollers 32.

The pair of transport rollers 32 for transporting the sheet P include a driving roller 37 that is rotated by a motor 36 about the rotation axis directed along a width direction X and a driven roller 38 that is rotated by following the rotation of the driving roller 37 about the rotation axis directed along a width direction X. While transporting the sheet P, the driving roller 37 comes into contact with the bottom side of the sheet P and the driven roller 38 comes into contact with the top side of the sheet P. In other words, the pair of transport rollers 32 transport the sheet P in such a manner that the driving roller 37 and the driven roller 38 rotate with the sheet P pinched vertically therebetween. Note that the pair of discharge rollers 33 and the pair of intermediate rollers 35 have similar configurations.

The supporting portion 60 is shaped like a plate and has an upper surface opposing the recording head 40, and the upper surface forms a supporting surface 61 for coming into contact with and thereby supporting the sheet P. The supporting portion 60 also has a dumping portion 62 capable of receiving ink ejected from the recording head 40. Note that the dumping portion 62 according to the present embodiment includes through-holes 63 passing through the supporting portion 60 in a vertical direction. A container 50 for containing the ink that is ejected onto the dumping portion 62 is provided below the supporting portion 60. The container 50 has an opening 51 in an upper part thereof, and the opening 51 is in communication with the through-holes 63 that are included in the dumping portion 62 of the supporting portion 60. The container 50 also has a containing chamber 52 capable of containing the ink that has passed through the opening 51. The containing chamber 52 has an ink absorbent material (not shown) such as a sponge. The container 50 further includes a fan 53 for drawing ink droplets or the like suspended in air into the containing chamber 52 through the opening 51. Note that when the sheet P is transported over the supporting portion 60, this fan 53 draws the sheet P via the dumping portion 62, which enables stable transportation of the sheet P.

A recording head 40 is fixedly disposed at a position above and opposite the supporting portion 60. The recording head 40 has a plurality of nozzles 42 disposed on an ejection surface 41 that is the bottom surface of the recording head 40. The nozzles 42 eject ink to record on the sheet P. Note that this recording head 40 is configured as a long head called a "line head" that can eject ink approximately simultaneously over the length of the sheet P in the width direction X. The recording head 40 according to the present embodiment appropriately performs "flushing", that is, an action of ejecting ink strongly from the nozzles 42, for the purpose of avoiding an increase in ink viscosity or ink adhesion inside the nozzles 42 due to drying. The ink ejecting properties of the nozzles in the recording head 40 are maintained or recovered by the flushing. Thus, the nozzles 42 of the recording head 40 eject ink onto the dumping portion 62 by the flushing, and the dumping portion 62 disposed in the supporting portion 60 allows the ink to pass through the supporting portion 60 and to be directed toward the container 50.

Figure 2:
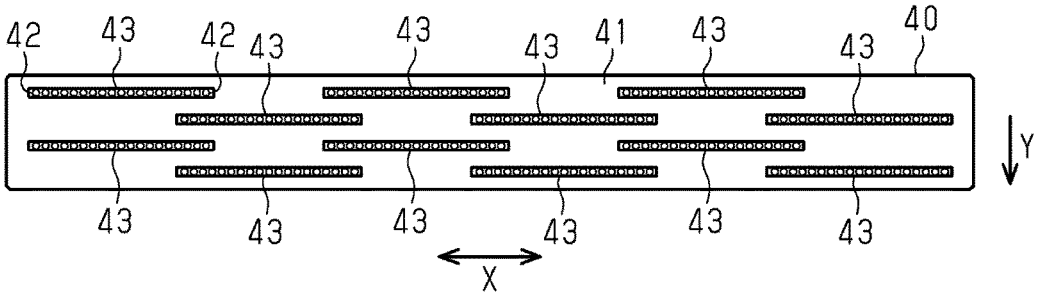
FIG. 2 is a bottom plan view of a recording head according to the first embodiment and illustrates a nozzle arrangement.

As illustrated in FIG. 2, a plurality of nozzle rows 43 each including a plurality of nozzles 42 are provided on the ejection surface 41 of the recording head 40. The nozzle rows 43, each of which is formed of a plurality of nozzles 42 arranged side by side in the width direction X, are disposed such that adjacent nozzle rows 43 are parallel to each other on the ejection surface 41. In addition, the nozzle rows 43 are grouped into four queues in the transport direction Y, and the queues are arranged with a predetermined spacing between each other in the width direction X. In other words, the nozzle rows 43 disposed on the ejection surface 41 of the recording head 40 are arranged in a staggered manner along the width direction X. Moreover, when the ejection surface 41 is viewed in the transport direction Y, the adjacent nozzle rows 43 in the width direction X are arranged such that a portion of each one overlaps that of the adjacent one. In other words, when the ejection surface 41 is viewed in the transport direction Y, the nozzles 42 look like a continuous line without gaps in the width direction X.

Figure 3:
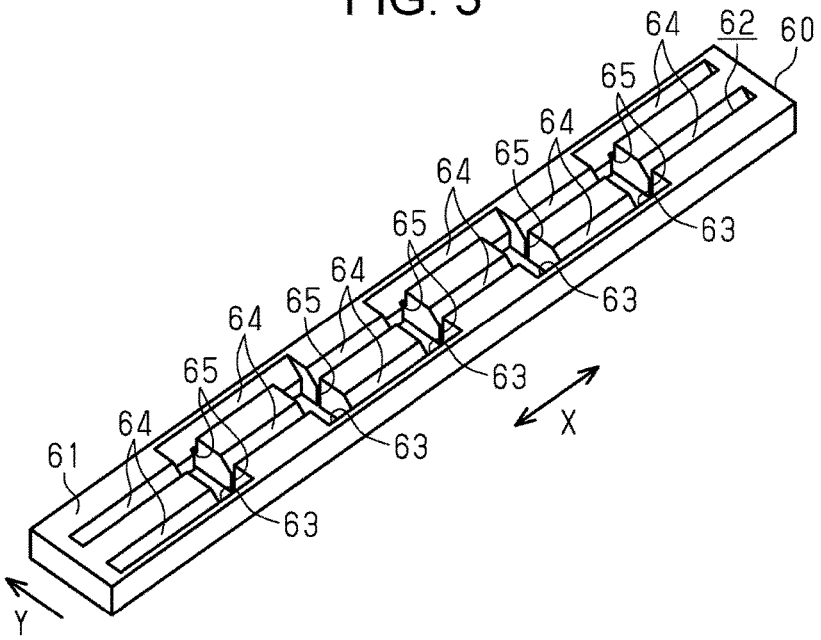
FIG. 3 is a perspective view illustrating a supporting portion according to the first embodiment.
Figure 4:
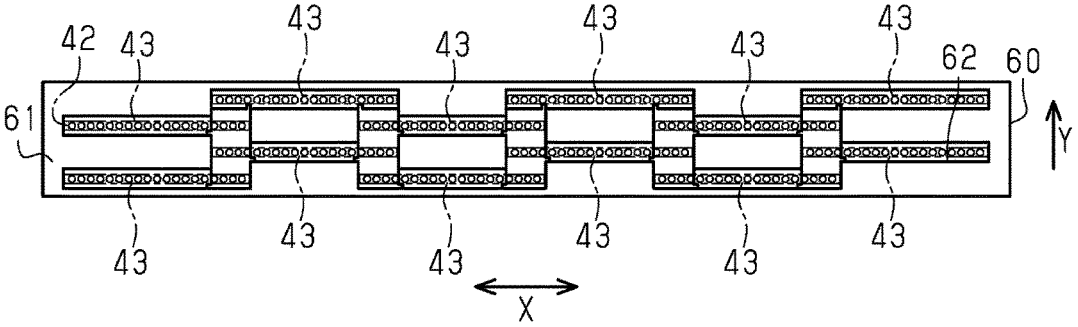
FIG. 4 is a plan view of the supporting portion according to the first embodiment and illustrates a positional relationship between a dumping portion and nozzle rows.

As illustrated in FIG. 3 and FIG. 4, the supporting portion 60 is configured to extend over the length of the sheet P in the width direction X. The dumping portion 62 disposed in the supporting portion 60 is provided to include positions opposite the nozzle rows 43 of the recording head 40. In addition, the dumping portion 62 according to the present embodiment is provided in such a manner that the dumping portion 62 connects with each other the positions on the supporting portion 60 opposite the respective nozzle rows 43. In other words, the dumping portion 62, which is disposed in a central part of the supporting portion 60 in the transport direction Y, extends along the width direction X in a staggered manner similar to the staggered arrangement of the nozzle rows 43 disposed on the ejection surface 41 of the recording head 40. The ink ejected from the nozzles 42 by the flushing passes through the through-holes 63 included in the dumping portion 62, and is received in the container 50. In addition, the supporting surface 61 for supporting the sheet P is provided at positions on the upper surface of the supporting portion 60 where the dumping portion 62 is not provided, that is, where the nozzle rows 43 of the recording head 40 do not oppose. Note that the supporting surface 61 is a flat and level surface.

Figure 5:
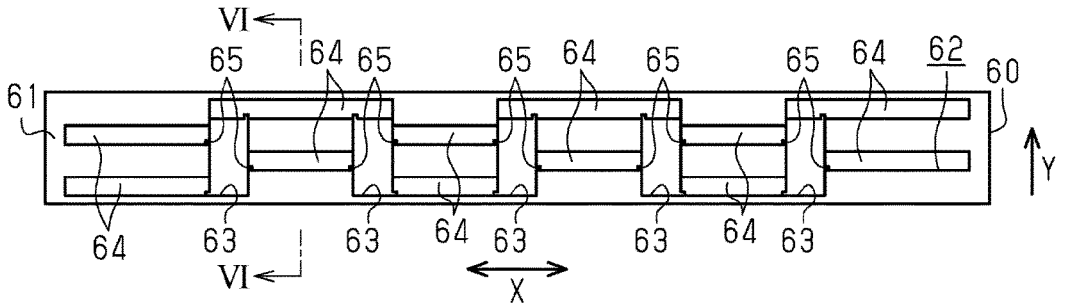
FIG. 5 is a plan view illustrating the supporting portion according to the first embodiment.
Figure 6:
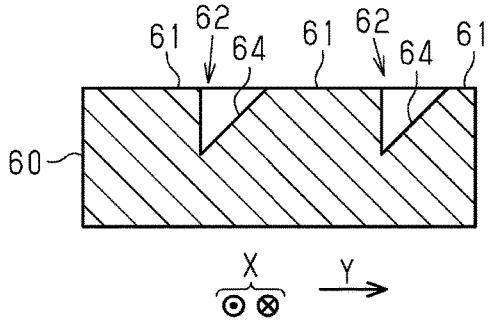
FIG. 6 is a cross-sectional view taken along a line VI-VI in FIG. 5.

As illustrated in FIG. 5 and FIG. 6, the dumping portion 62 of the present embodiment is configured to include the through-holes 63 and slopes 64. The slopes 64 incline relative to the supporting surface 61. Each slope 64 is formed in continuity with the supporting surface 61 and is inclined upward from the upstream side toward the downstream side in the transport direction Y. In other words, the slope 64 is inclined upward toward the supporting surface 61. In addition, a plurality of grooves 65 are formed in the slopes 64 at positions adjacent to the through-holes 63. The grooves 65 extend in a vertical direction similarly to the through-holes 63. Each groove 65 is formed such that the width of the groove 65 becomes smaller as it goes down through the supporting portion 60 from the slope 64. The ink ejected onto the slopes 64, which is a portion of the ink ejected onto the dumping portion 62 from the recording head 40 by the flushing, flows along the slopes 64 into the through-holes 63 or the grooves 65, passes through the through-holes 63 or the grooves 65, and is received in the container 50. Note that at least slopes 64 have water repellency in the supporting portion 60. In order to provide the slopes 64 with water repellency, the slopes 64 may be configured, for example, to include a material having an excellent water-repellency, such as a fluorine-based resin, or to be coated with a fluorine-based material.

Next, the operation of the recording apparatus 11 of the first embodiment configured as described above will be described. As illustrated in FIG. 4 and FIG. 5, the supporting portion 60 of the first embodiment has the dumping portion 62 provided to include the positions opposite the nozzle rows 43 of the recording head 40, and also has the supporting surface 61 for supporting a sheet P at the other positions. Here, when a sheet P is transported over the supporting portion 60, an end of the sheet P may be positioned above the dumping portion 62 during transportation. In such a case, the end of the sheet P often falls into the dumping portion 62, which may cause the sheet P supported by the supporting portion 60 to be tilted or warped and to lose balance.

The supporting portion 60 according to the present embodiment, however, has the slopes 64 provided in the dumping portion 62, and the slopes 64 can support the end of the sheet P located above the dumping portion 62. In other words, in the supporting portion 60, not only the supporting surface 61 but also the slopes 64 that are part of the dumping portion 62 contribute to the supporting of the sheet P. This configuration makes it easier to maintain stable positioning of the sheet P. In other words, as compared with a supporting portion 60 that does not have the slopes 64, the supporting portion 60 in the present embodiment can provide more regions contributing to the supporting of the sheet P. Thus, this configuration makes it easier to secure flatness of the sheet P. Note that when ink is ejected onto the slopes 64 during the flushing, the ink does not readily stay on the slopes 64 because the slopes 64 have water repellency. This means that when the slopes 64 support the sheet P, there is a lower likelihood of the sheet P becoming stained.

According to the first embodiment, the following effects can be obtained:

(1) Even when part of the sheet P transported over the supporting surface 61 of the supporting portion 60 falls into the dumping portion 62, the sheet P can be supported by the slopes 64 provided in the dumping portion 62. In other words, even the portions in the supporting portion 60 that are opposite the nozzle rows 43 of the recording head 40 can contribute to the supporting of the sheet P. Thus, this makes it possible to stably obtain the flatness of the sheet P supported by the supporting portion 60 that allows the recording head 40 for ejecting ink to perform flushing.

(2) The container 50 contains the ink ejected onto the dumping portion 62 of the supporting portion 60, which allows the recording apparatus 11 to be used continuously for a long time.

(3) The grooves 65 can facilitate the collection of the ink ejected onto the slopes 64.

(4) The capillary action of the grooves 65 can further facilitate the collection of the ink ejected onto the slopes 64.

(5) The water repellency of the slopes 64 allows the ink ejected onto the slopes 64 by the flushing to flow swiftly, which can lower the likelihood of the sheet P being stained when the transported sheet P touches the slopes 64.

Second Embodiment

Next, a recording apparatus 11 according to a second embodiment will be described. In the recording apparatus 11 according to the second embodiment, the configuration of the supporting portion 60 for supporting the sheet P is different from that of the first embodiment while other configurations are similar to those of the first embodiment. Thus, no further description is provided for the portion having the similar configuration.

Figure 7:
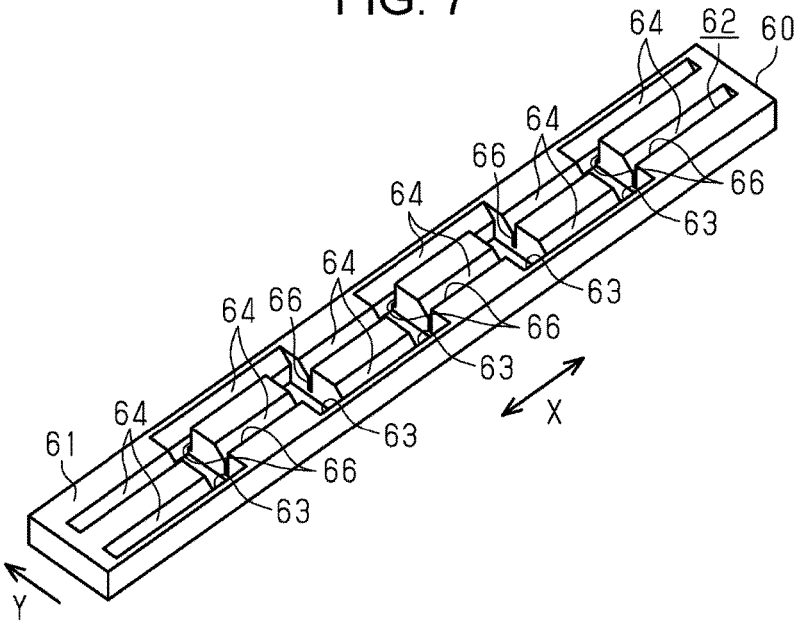
FIG. 7 is a perspective view illustrating a supporting portion included in a recording apparatus according to a second embodiment.
Figure 8:
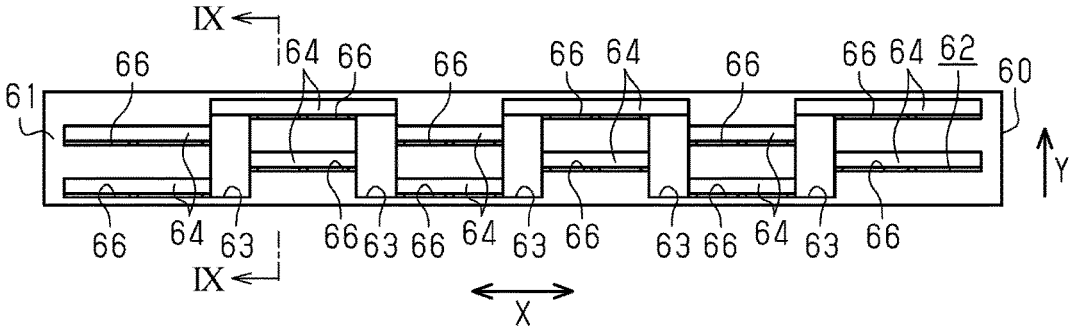
FIG. 8 is a plan view illustrating the supporting portion according to the second embodiment.
Figure 9:
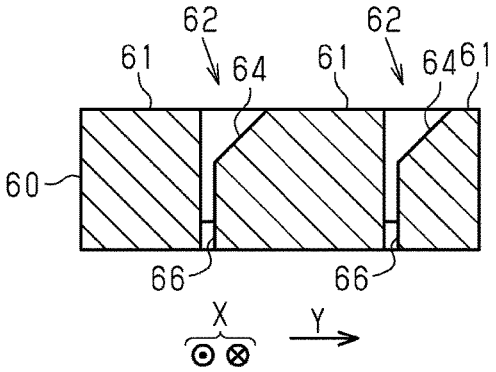
FIG. 9 is a cross-sectional view taken along a line IX-IX in FIG. 8.

As illustrated in FIGS. 7, 8, and 9, the supporting portion 60 of the second embodiment has slits 66 as part of the dumping portion 62. Each slit 66 has an opening of which the width in the transport direction Y is smaller than that of the through-hole 63. In FIG. 8, through-holes 63 are formed at the lowest end of each slope 64 at two positions along the width direction X. This slit 66 is provided at a position next to a through-hole 63 and on the upstream side of a slope 64 in the transport direction Y. The slit 66 passes through the supporting portion 60 in a vertical direction similarly to the through-hole 63. Thus, the ink ejected onto the slopes 64 flows along the slopes 64 into the through-holes 63 or the slits 66, passes through the through-holes 63 or the slits 66, and is received in the container 50. The slits 66 as well as the through-holes 63 allow ink to be directed to the container 50, and thus this configuration further facilitates the collection of the ink.

According to the second embodiment, the following effect can be obtained in addition to the effects of (1), (2), and (5):

(6) Providing the slits 66 in addition to the through-holes 63 can further facilitate the collection of the ink ejected onto the slopes 64.

Third Embodiment

Next, a recording apparatus 11 according to a third embodiment will be described. In the recording apparatus 11 according to the third embodiment, the configuration of the supporting portion 60 for supporting the sheet P is different from that of the first embodiment while other configurations are similar to those of the first embodiment. Thus, no further description is provided for the portion having the similar configuration.

Figure 10:
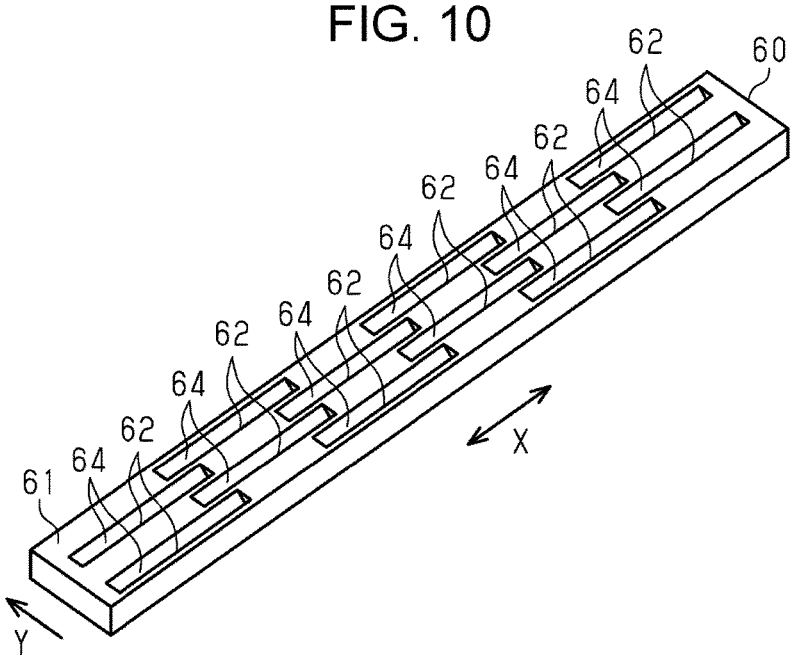
FIG. 10 is a perspective view illustrating a supporting portion included in a recording apparatus according to a third embodiment.
Figure 11:
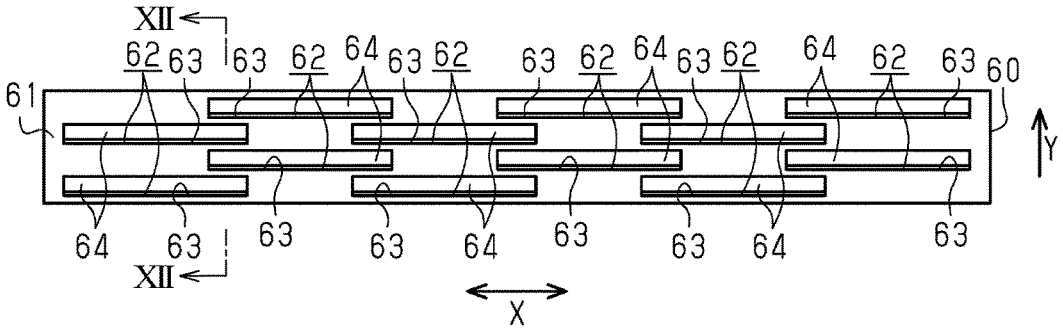
FIG. 11 is a plan view illustrating the supporting portion according to the third embodiment.
Figure 12:
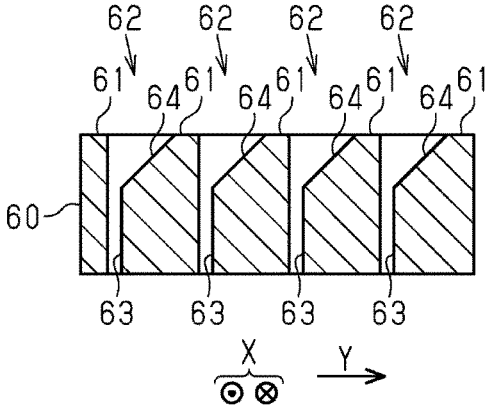
FIG. 12 is a cross-sectional view taken along a line XII-XII in FIG. 11.

As illustrated in FIGS. 10, 11, and 12, the supporting portion 60 according to the third embodiment has separate dumping portions 62 at positions opposite respective nozzle rows 43 of the recording head 40. In other words, the supporting portion 60 has the same number of dumping portions 62 as that of the nozzle rows 43 included in the recording head 40. Each dumping portion 62 has a slope 64 inclined upward from the upstream side toward the downstream side in the transport direction Y. Each dumping portion 62 also has a through-hole 63 passing through the supporting portion 60 in a vertical direction. Note that the through-hole 63 has a slit-like opening in this case. This through-hole 63 is provided on the upstream side of the slope 64. Thus, the ink ejected onto the slopes 64 flows along the slopes 64 into the through-holes 63, passes through the through-holes 63, and is received in the container 50. Note that providing separate dumping portions 62 allows the supporting surface 61 to have a larger area.

According to the third embodiment, the following effect can be obtained in addition to the effects of (1), (2), and (5):

(7) The ink ejected onto the dumping portions 62 can be collected via respective through-holes 63.

Fourth Embodiment

Next, a recording apparatus 11 according to a fourth embodiment will be described. In the recording apparatus 11 according to the fourth embodiment, the configurations of the supporting portion 60 for supporting the sheet P and the recording head 40 for recording on the sheet P are different from those of the first embodiment while other configurations are similar to those of the first embodiment. Thus, no further description is provided for the portion having the similar configuration.

Figure 13:
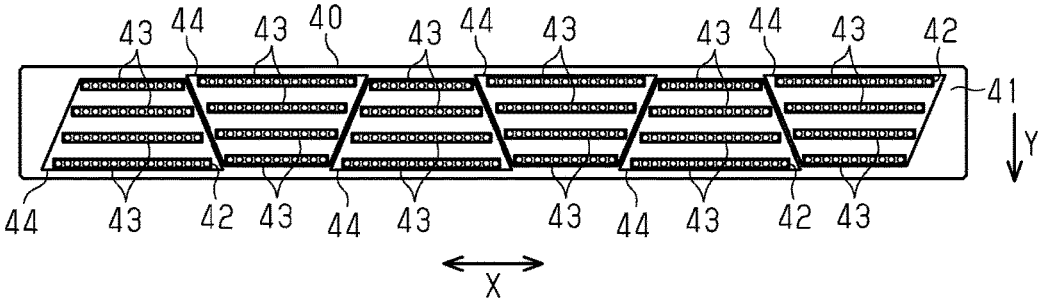
FIG. 13 is a bottom plan view illustrating a recording head included in a recording apparatus according to a fourth embodiment.

As illustrated in FIG. 13, the recording head 40 of the fourth embodiment has a plurality of nozzle groups 44 provided on the ejection surface 41, and each nozzle group 44 is formed of a plurality of nozzle rows 43 each extending in the width direction X. Each of the nozzle groups 44 is formed of four nozzle rows 43 arrayed in the transport direction Y. In addition, the nozzle rows 43 that form one nozzle group 44 have different lengths in the width direction X such that one nozzle group 44 forms a trapezoidal shape. The nozzle groups 44, each of which forms a trapezoidal shape, are arranged on the ejection surface 41 along the width direction X in such a manner that the trapezoids are alternately oriented in opposite directions.

Figure 14:
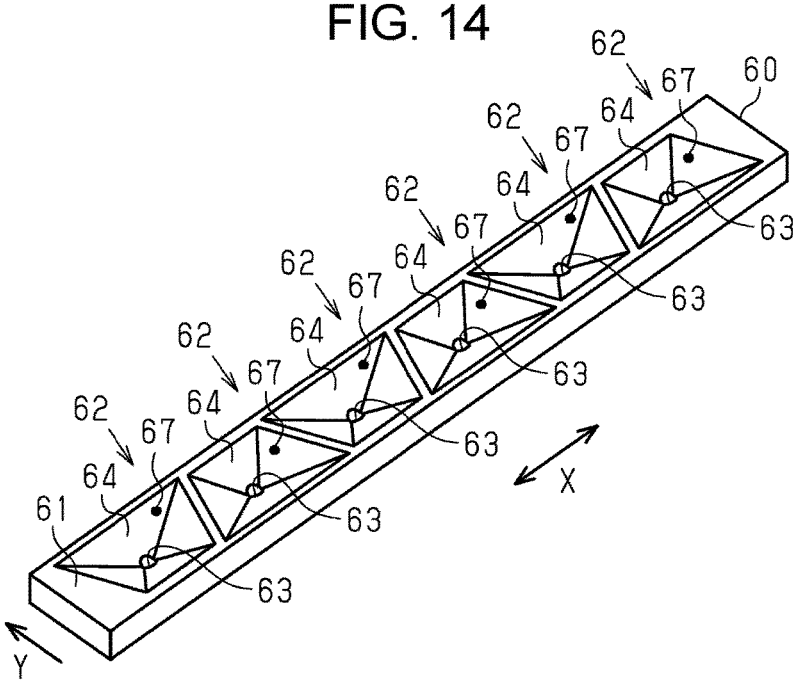
FIG. 14 is a perspective view illustrating a supporting portion according to the fourth embodiment.
Figure 15:
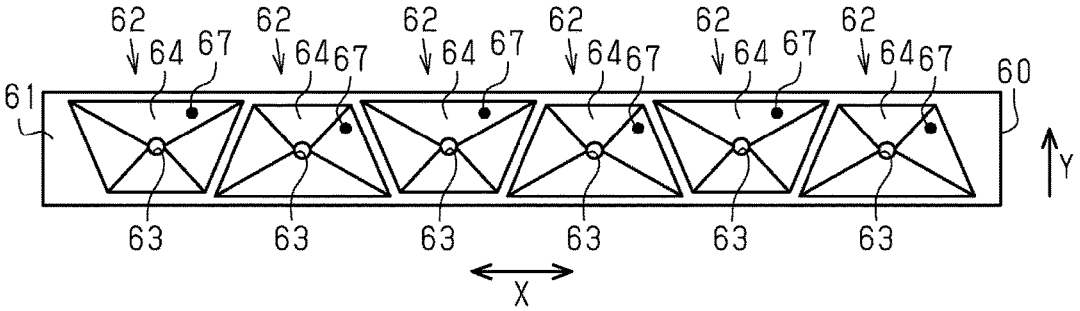
FIG. 15 is a plan view illustrating the supporting portion according to the fourth embodiment.

As illustrated in FIG. 14 and FIG. 15, the supporting portion 60 opposing the recording head 40 has separate dumping portions 62 at positions opposite respective nozzle groups 44 formed of the nozzle rows 43. In other words, the supporting portion 60 has the same number of dumping portions 62 as that of the nozzle groups 44 included in the recording head 40. Each dumping portion 62 has an opening 67 at an upper part of the supporting portion 60 and also has a through-hole 63 passing through the supporting portion 60 in a vertical direction from the opening 67. Note that this opening 67 is trapezoidally shaped in accordance with the shape of each nozzle group 44.

In addition, the through-hole 63 is formed at the center of the opening 67, that is, at the center both in the transport direction Y and in the width direction X. This dumping portion 62 is provided such that the opening 67 and the through-hole 63 form a funnel. In other words, the ink ejected onto this dumping portion 62 from the recording head 40 flows along the inner surface of the opening 67 into the through-hole 63, passes through the through-hole 63, and is received in the container 50.

The inner surface of the opening 67 is formed of four surfaces each inclined toward the through-hole. In other words, the opening 67 includes a slope 64 inclined upward from the upstream side toward the downstream side in the transport direction Y. The supporting surface 61 for supporting the sheet P is provided on the supporting portion 60 at positions not opposite the nozzle groups 44, for example, provided at positions opposite the spacings between the nozzle groups 44.

According to the fourth embodiment, the following effect can be obtained in addition to the effects of (1), (2), (5), and (7):

(8) Ink droplets and the like suspended in air can be collected efficiently in a configuration, for example, in which ink is sucked through the through-holes 63 by a pump or the like.

Fifth Embodiment

Next, a recording apparatus 11 according to a fifth embodiment will be described. In the recording apparatus 11 according to the fifth embodiment, the configurations of the supporting portion 60 for supporting the sheet P and the recording head 40 for recording on the sheet P are different from those of the fourth embodiment while other configurations are similar to those of the fourth embodiment. Thus, no further description is provided for the portion having the similar configuration.

Figure 16:
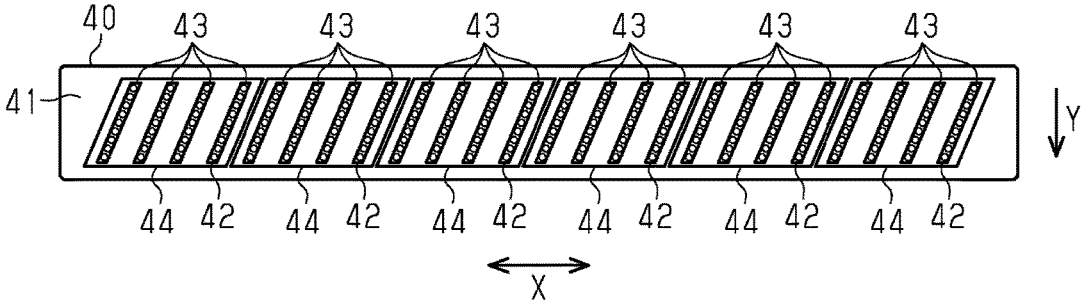
FIG. 16 is a bottom plan view illustrating a recording head included in a recording apparatus according to a fifth embodiment.

As illustrated in FIG. 16, the ejection surface 41 of the recording head 40 according to the fifth embodiment has a plurality of nozzle rows 43 each extending in a direction intersecting both the width direction X and the transport direction Y (i.e., extending in an oblique direction). These nozzle rows 43 are arranged parallel to each other with a predetermined spacing therebetween in the width direction X. In addition, the plurality of nozzle rows 43 form a plurality of nozzle groups 44 on the ejection surface 41. Each nozzle group 44 includes four nozzle rows 43 arrayed in the width direction X. In other words, the nozzle groups 44 are arranged side by side on the ejection surface 41 along the width direction X.

Figure 17:
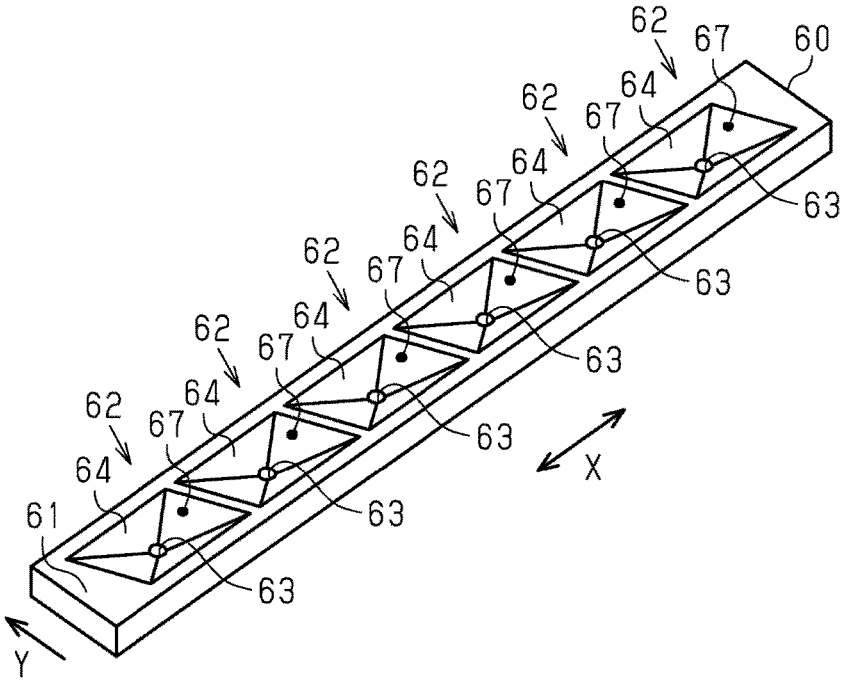
FIG. 17 is a perspective view illustrating a supporting portion according to the fifth embodiment.
Figure 18:
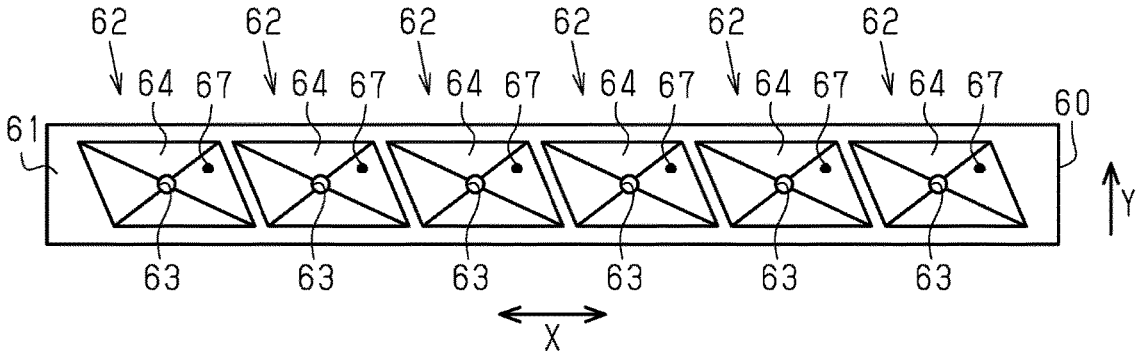
FIG. 18 is a plan view illustrating the supporting portion according to the fifth embodiment.

As illustrated in FIG. 17 and FIG. 18, the supporting portion 60 opposing this recording head 40 has separate dumping portions 62 at positions opposite respective nozzle groups 44 formed of the nozzle rows 43. In other words, the supporting portion 60 has the same number of dumping portions 62 as that of the nozzle groups 44 included in the recording head 40. Each dumping portion 62 has an opening 67 at an upper part of the supporting portion 60 and also has a through-hole 63 passing through the supporting portion 60 in a vertical direction from the opening 67. Note that this opening 67 is shaped in accordance with the shape of each nozzle group 44. The ink ejected onto this dumping portion 62 from the recording head 40 flows along the inner surface of the opening 67 into the through-holes 63, passes through the through-holes 63, and is received in the container 50. Note that the inner surface of the opening 67 is formed of four surfaces each inclined upward from the through-hole 63 toward the supporting surface 61. In other words, the opening 67 has a slope 64 inclined upward from the upstream side toward the downstream side in the transport direction Y.

According to the fifth embodiment, the effects of (1), (2), (5), (7), and (8) can be obtained.

Sixth Embodiment

Next, a recording apparatus 11 according to a sixth embodiment will be described. In the recording apparatus 11 according to the sixth embodiment, the configuration of the supporting portion 60 for supporting the sheet P is different from that of the first embodiment while other configurations are similar to those of the first embodiment. Thus, no further description is provided for the portion having the similar configuration.

Figure 19:
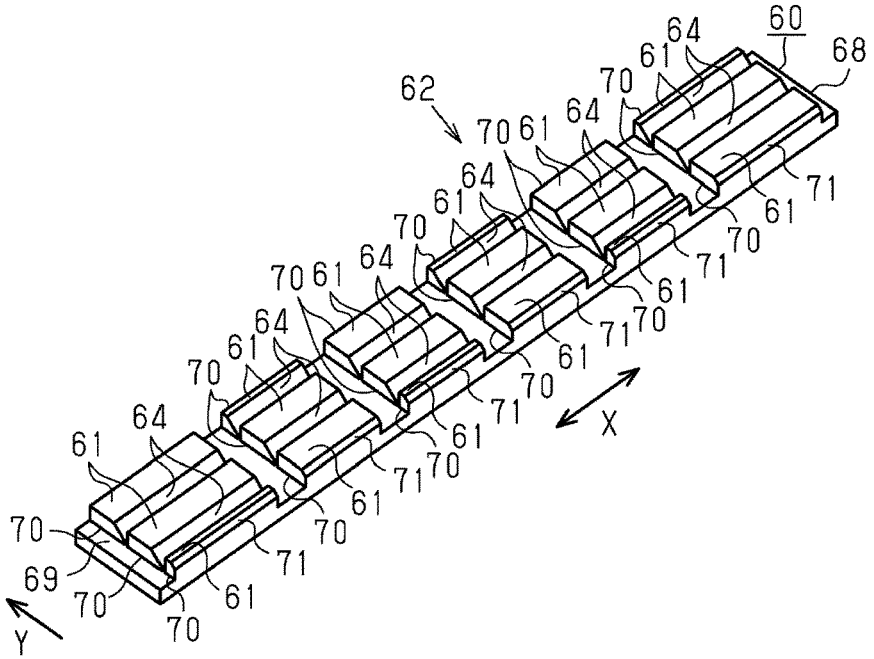
FIG. 19 is a perspective view illustrating a supporting portion included in a recording apparatus according to a sixth embodiment.
Figure 20:
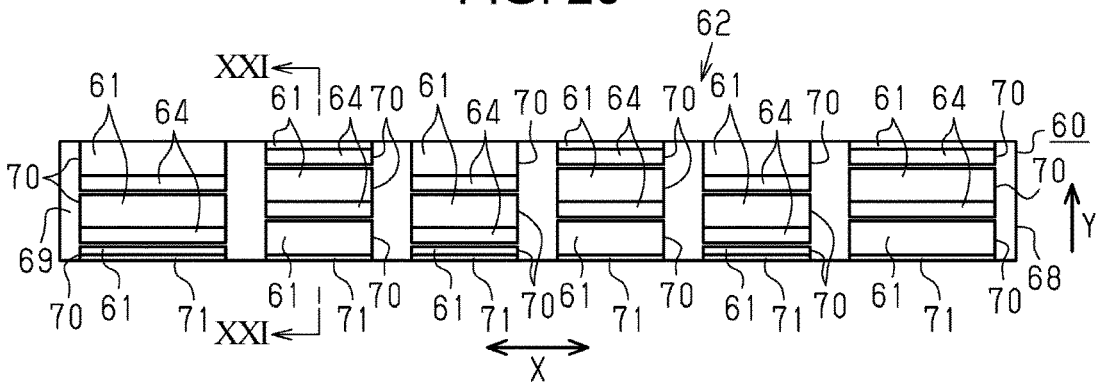
FIG. 20 is a plan view illustrating the supporting portion according to the sixth embodiment.
Figure 21:
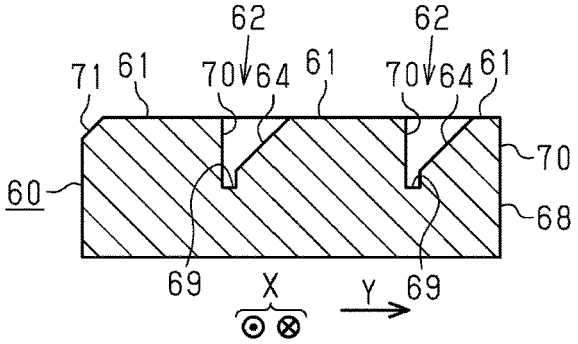
FIG. 21 is a cross-sectional view taken along a line XXI-XXI in FIG. 20.

As illustrated in FIGS. 19, 20, and 21, the supporting portion 60 of the sixth embodiment has a thin-plate base 68. This base 68 has a plurality of ribs (protrusions) 70 protruding upward from the upper surface 69 of the base 68, and the upper surfaces of the ribs 70 support the sheet P. In the supporting portion 60, these ribs 70 are arranged in rows in the width direction X with a predetermined spacing therebetween, and the arranged ribs 70 are also arranged in rows in the transport direction Y. In a rib 70, a slope 64 is provided on the upstream side of the rib 70 in the transport direction Y. The slope 64 continues to the upper surface of the rib 70 and inclines from the upper surface of the rib 70 toward the upper surface 69 of the base 68. In other words, this slope 64 inclines upward from the upstream side toward the downstream side in the transport direction Y.

This supporting portion 60 includes supporting surfaces 61 for supporting the sheet P and a dumping portion 62 that can receive the ink ejected from the nozzles 42 of the recording head 40 during the flushing. In other words, in the supporting portion 60 of the sixth embodiment, the upper surface of each rib 70 serves as the supporting surfaces 61, and the slopes 64 of the ribs 70 and the upper surface 69 of the base 68 serve as the dumping portion 62. Note that each supporting surface 61 is provided at such a height that the supporting surfaces 61 form a level plane. When the recording head 40 performs flushing, ink is ejected onto the upper surface 69 of the base 68 and the slopes 64. The ink ejected onto the slopes 64 flows along the slopes 64 to the upper surface 69 of the base 68 and then flows from the upper surface 69 of the base 68 into the container 50. Thus, the ink is received in the container 50. Note that a chamfer portion 71, which is formed by chamfering off the edges of ribs 70, is provided in the supporting portion 60 at the upper edge thereof on the upstream side in the transport direction Y. This chamfer portion 71 reduces the likelihood of the front end of the sheet P transported along the transport path being caught by the supporting portion 60.

According to the sixth embodiment, the following effect can be obtained in addition to the effects of (1), (2), and (5): (9) Providing the slope 64 on the upstream side of the rib 70 in the transport direction Y can reduce the likelihood of the front end of the transported sheet P being caught by the rib 70.

Seventh Embodiment

Next, a recording apparatus 11 according to a seventh embodiment will be described. In the recording apparatus 11 according to the seventh embodiment, the configuration of the supporting portion 60 for supporting the sheet P is different from that of the sixth embodiment while other configurations are similar to those of the sixth embodiment. Thus, no further description is provided for the portion having the similar configuration.

Figure 22:
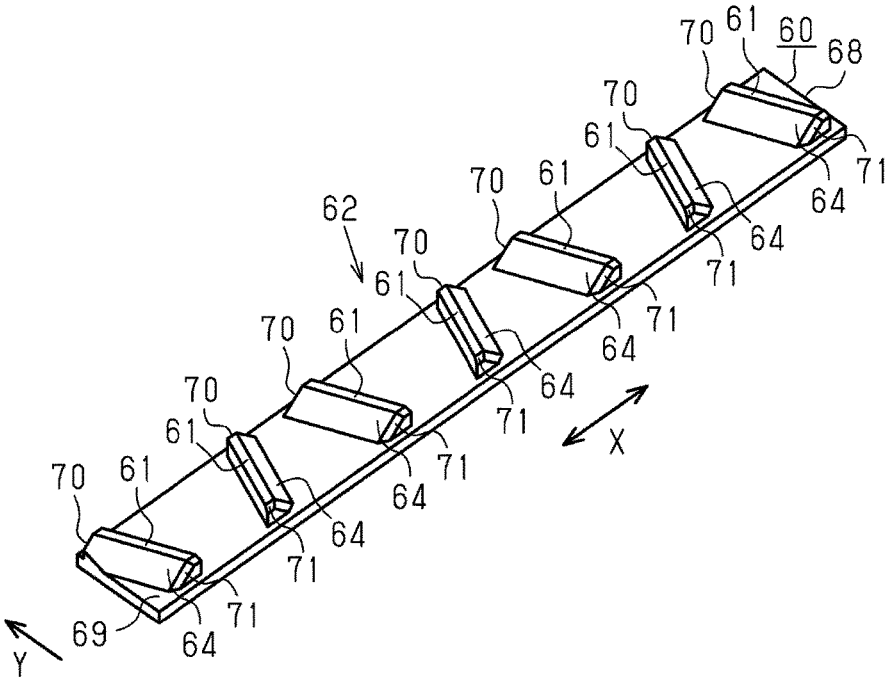
FIG. 22 is a perspective view illustrating a supporting portion included in a recording apparatus according to a seventh embodiment.
Figure 23:
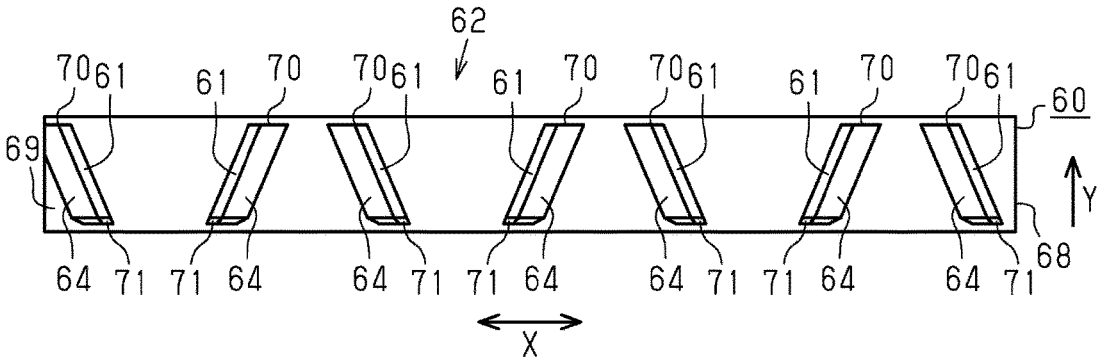
FIG. 23 is a plan view illustrating the supporting portion according to the seventh embodiment.

As illustrated in FIG. 22 and FIG. 23, the supporting portion 60 of the seventh embodiment has a plurality of ribs 70 disposed on the upper surface 69 of the base 68. Each of the plurality of ribs 70 extends in a direction intersecting both the width direction X and the transport direction Y of the sheet P (i.e., in an oblique direction). The plurality of the ribs 70 are arranged in the width direction X on the upper surface 69 of the base 68 in such a manner that the ribs 70 alternately extend in different directions. Each rib 70 has a supporting surface 61 for supporting the sheet P and a slope 64 inclined toward the upper surface 69 of the base 68 from the supporting surface 61, that is, the upper surface of the rib 70.

When the center line of the rib 70 is taken along the direction of the obliquely-extending rib 70, the slope 64 is provided on the side of the rib 70 that faces upstream in the transport direction Y with respect to the center line. The slope 64 inclines upward from the upper surface 69 of the base 68 toward the supporting surface 61 and also from the upstream side toward the downstream side in the transport direction Y. In other words, the slope 64 is provided on the upstream side of the rib (protrusion) 70 in the transport direction Y. In addition, a chamfer portion 71, which is formed by chamfering off the edges of ribs 70, is provided in the supporting portion 60 at the upper edge thereof on the upstream side in the transport direction Y.

According to the seventh embodiment, the effects of (1), (2), (5), and (9) can be obtained.

Eighth Embodiment

Next, a recording apparatus 11 according to an eighth embodiment will be described. In the recording apparatus 11 according to the eighth embodiment, the configuration of the supporting portion 60 for supporting the sheet P is different from that of the seventh embodiment while other configurations are similar to those of the seventh embodiment. Thus, no further description is provided for the portion having the similar configuration.

Figure 24:
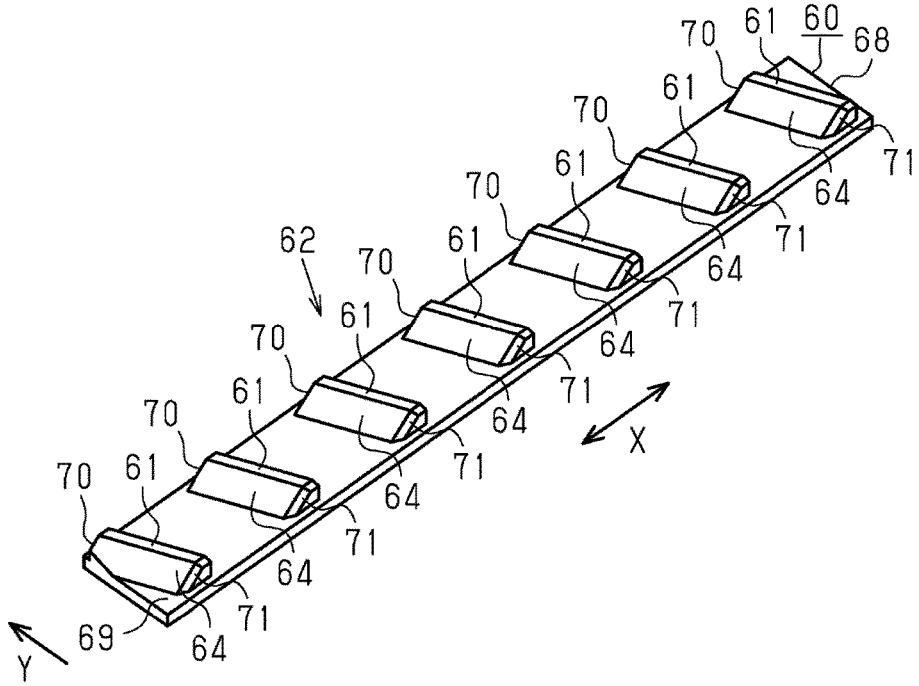
FIG. 24 is a perspective view illustrating a supporting portion included in a recording apparatus according to an eighth embodiment.
Figure 25:
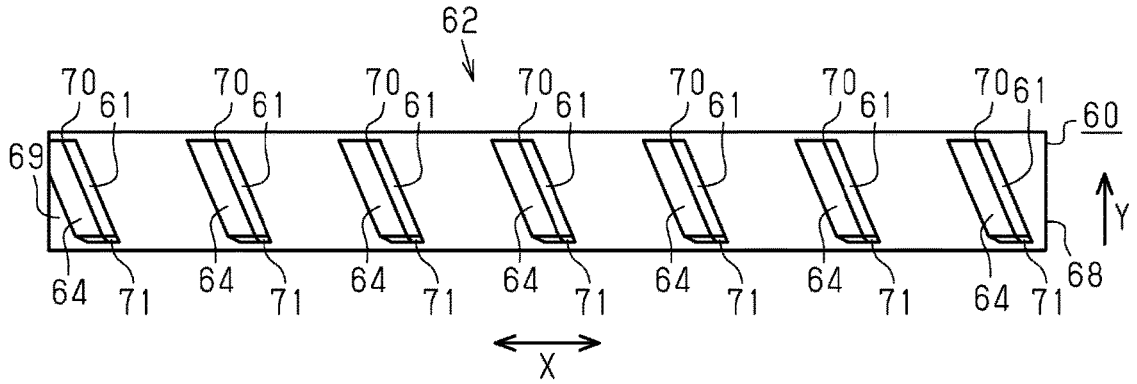
FIG. 25 is a plan view illustrating the supporting portion according to the eighth embodiment.

As illustrated in FIG. 24 and FIG. 25, the supporting portion 60 of the eighth embodiment has a plurality of ribs 70 disposed on the upper surface 69 of the base 68. Each of the plurality of ribs 70 extends in a direction intersecting both the width direction X and the transport direction Y of the sheet P (i.e., in an oblique direction). The plurality of the ribs 70 are arranged side by side in the width direction X on the upper surface 69 of the base 68 in such a manner that the ribs 70 extend parallel to each other. Each rib 70 has a supporting surface 61 for supporting the sheet of paper P and a slope 64 inclined toward the upper surface 69 of the base 68 from the supporting surface 61, that is, the upper surface of the rib 70. When the center line of the rib 70 is taken along the direction of the obliquely-extending rib 70, the slope 64 is provided on the side of the rib 70 that faces upstream in the transport direction Y with respect to the center line. The slope 64 inclines upward from the upper surface 69 of the base 68 toward the supporting surface 61 of the rib 70 along the transport direction Y. In other words, the slope 64 is provided on the upstream side of the rib (protrusion) 70 in the transport direction Y.

According to the eighth embodiment, the effects of (1), (2), (5), and (9) can be obtained.

Ninth Embodiment

Next, a recording apparatus 11 according to a ninth embodiment will be described. In the recording apparatus 11 according to the ninth embodiment, the configuration of the supporting portion 60 for supporting the sheet P is different from that of the sixth embodiment while other configurations are similar to those of the sixth embodiment. Thus, no further description is provided for the portion having the similar configuration.

Figure 26:
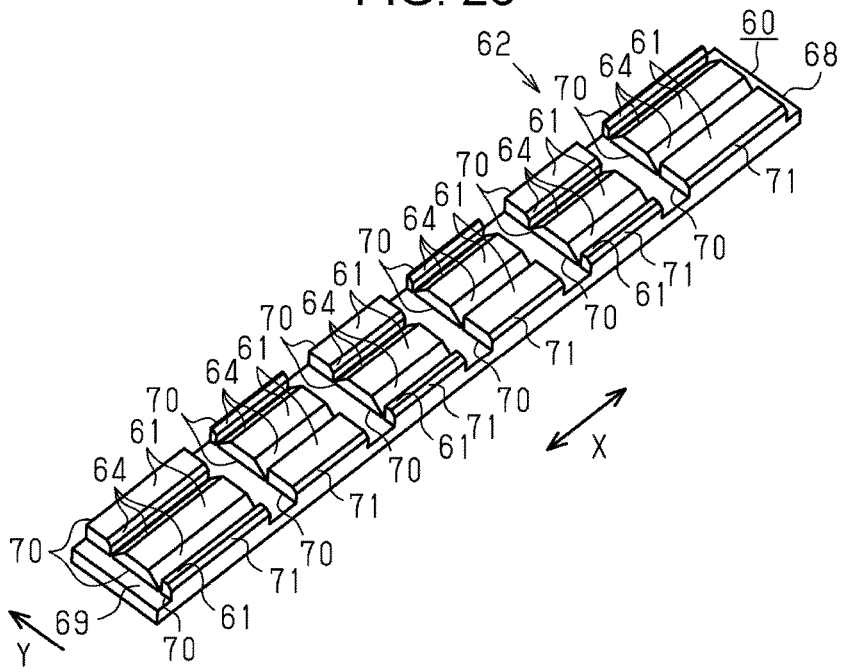
FIG. 26 is a perspective view illustrating a supporting portion included in a recording apparatus according to a ninth embodiment.
Figure 27:
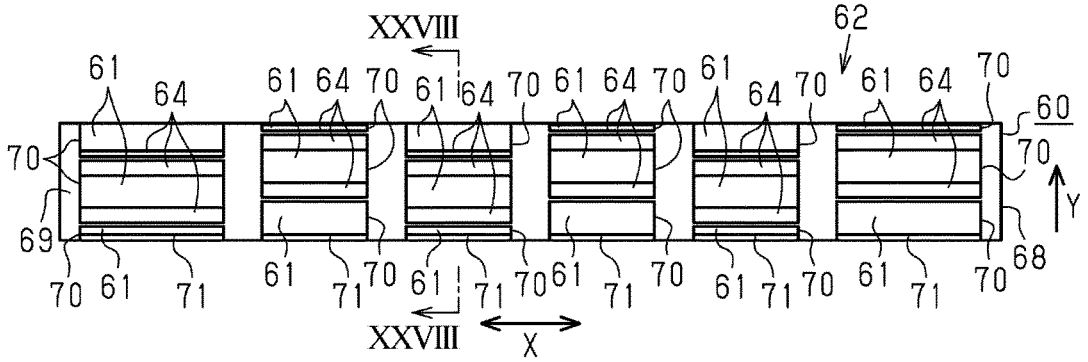
FIG. 27 is a plan view illustrating the supporting portion according to the ninth embodiment.
Figure 28:
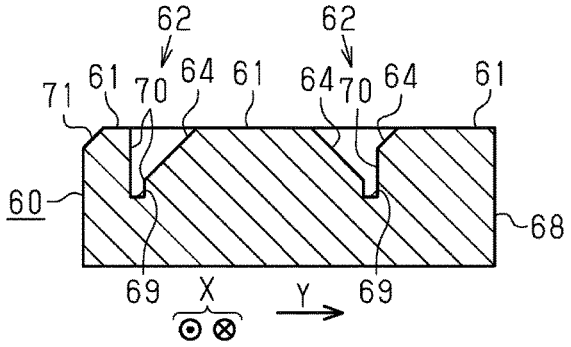
FIG. 28 is a cross-sectional view taken along a line XXVIII-XXVIII in FIG. 27.

As illustrated in FIGS. 26, 27, and 28, the supporting portion 60 of the ninth embodiment has a thin-plate base 68. This base 68 has a plurality of ribs (protrusion) 70 protruding upward from the upper surface 69 of the base 68. The support surfaces 61, which are the upper surfaces of the ribs 70, support the sheet P. Each rib 70 has slopes 64 disposed both on the upstream side and the downstream side in the transport direction Y. Each slope 64 inclines from the supporting surface 61 toward the upper surface 69 of the base 68. In other words, the slope 64 disposed on the upstream side of the rib 70 in the transport direction Y inclines upward from the upstream side toward the downstream side while the slope 64 disposed on the downstream side of the rib 70 inclines downward from the upstream side toward the downstream side. Note that each of these slopes 64 is part of the dumping portion 62.

According to the ninth embodiment, the following effect can be obtained in addition to the effects of (1), (2), (5), and (9):

(10) Even when the rear end of the transported sheet P falls into the dumping portion 62, the sheet P can be supported by the slope 64 provided on the downstream side of the rib 70.

Tenth Embodiment

Next, a recording apparatus 11 according to a tenth embodiment will be described. In the recording apparatus 11 according to the tenth embodiment, the configuration of the supporting portion 60 for supporting the sheet P is different from that of the seventh embodiment while other configurations are similar to those of the seventh embodiment. Thus, no further description is provided for the portion having the similar configuration.

Figure 29:
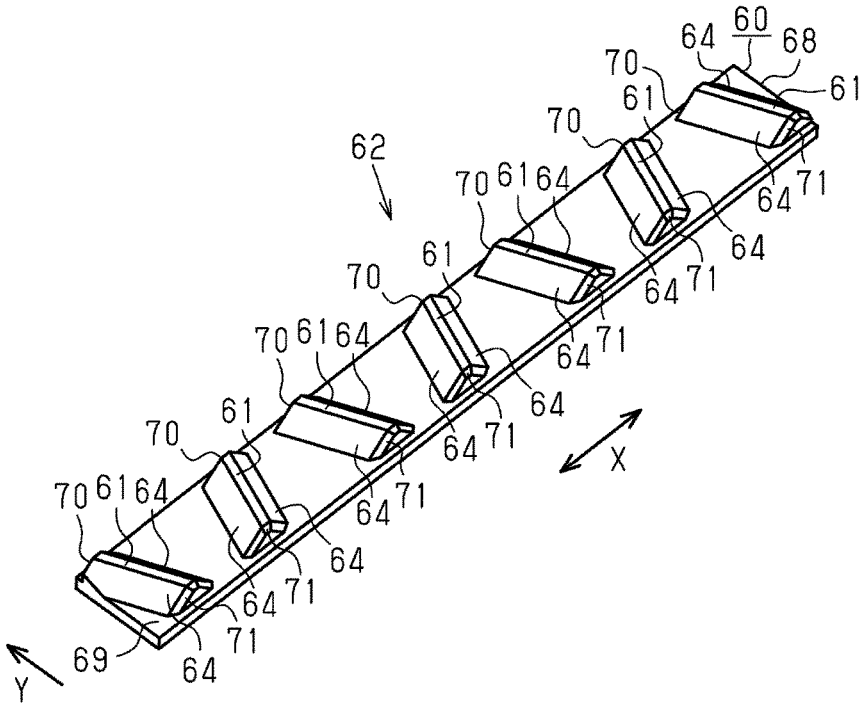
FIG. 29 is a perspective view illustrating a supporting portion included in a recording apparatus according to a tenth embodiment.
Figure 30:
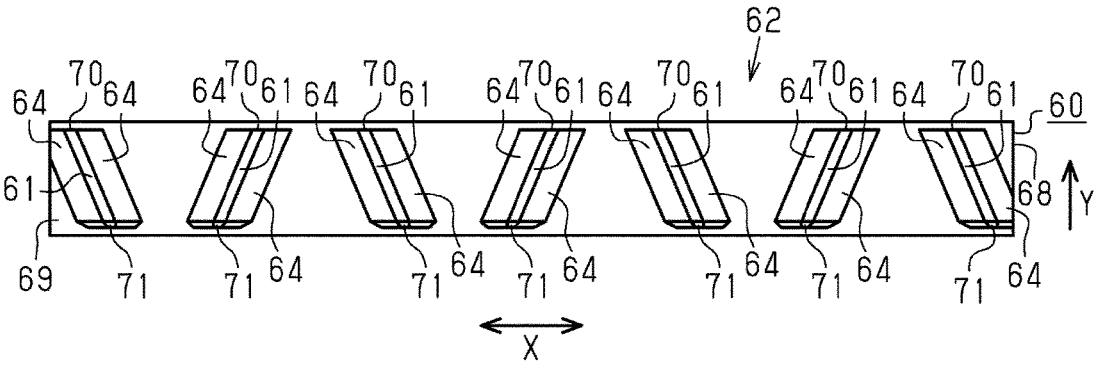
FIG. 30 is a plan view illustrating the supporting portion according to the tenth embodiment.

As illustrated in FIG. 29 and FIG. 30, the supporting portion 60 of the tenth embodiment has a plurality of ribs 70 disposed on the upper surface 69 of the base 68. Each of the plurality of ribs 70 extends in a direction intersecting both the width direction X and the transport direction Y of the sheet P (i.e., in an oblique direction). The plurality of the ribs 70 are arranged in the width direction X on the upper surface 69 of the base 68 in such a manner that the ribs 70 alternately extend in different directions. Each rib 70 has a supporting surface 61 for supporting the sheet P and slopes 64 inclined toward the upper surface 69 of the base 68 from the supporting surface 61, that is, the upper surface of the rib 70.

When the center line of the rib 70 is taken along the direction of the obliquely-extending rib 70, the slope 64 is provided on the side facing upstream and also on the side facing downstream in the transport direction Y with respect to the center line. In other words, the slope 64 is provided both on the upstream side and on the downstream side of the rib 70 in the transport direction Y. The slope 64 disposed on the upstream side of the rib 70 in the transport direction Y inclines upward from the upstream side toward the downstream side while the slope 64 disposed on the downstream side of the rib 70 inclines downward from the upstream side toward the downstream side. A chamfer portion 71, which is formed by chamfering off the edges of ribs 70, is provided in the supporting portion 60 at the upper edge thereof on the upstream side in the transport direction Y.

According to the tenth embodiment, the effects of (1), (2), (5), (9), and (10) can be obtained.

Eleventh Embodiment

Next, a recording apparatus 11 according to an eleventh embodiment will be described. In the recording apparatus 11 according to the eleventh embodiment, the configuration of the supporting portion 60 for supporting the sheet P is different from that of the eighth embodiment while other configurations are similar to those of the eighth embodiment. Thus, no further description is provided for the portion having the similar configuration.

Figure 31:
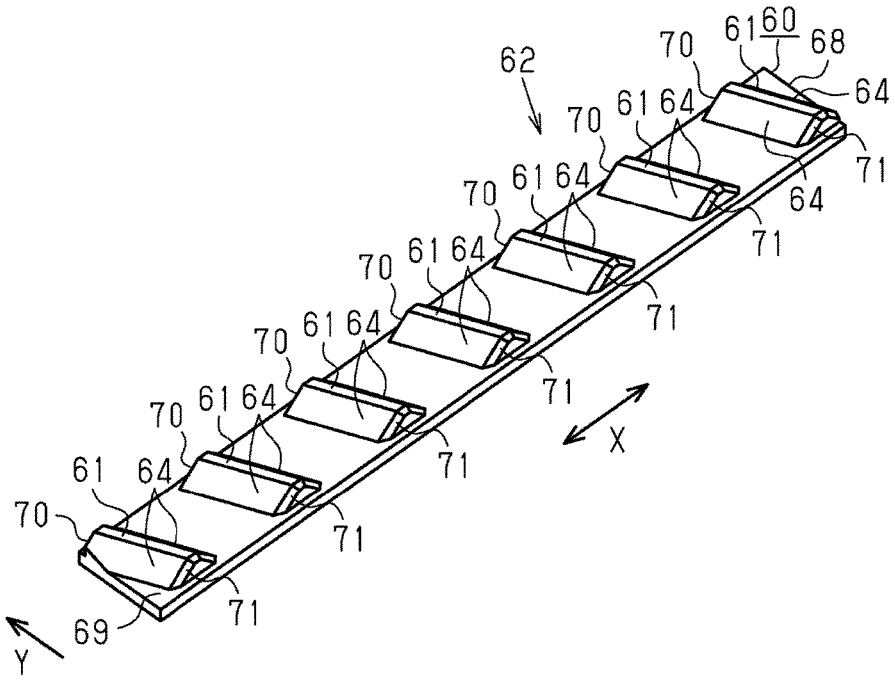
FIG. 31 is a perspective view illustrating a supporting portion included in a recording apparatus according to an eleventh embodiment.
Figure 32:
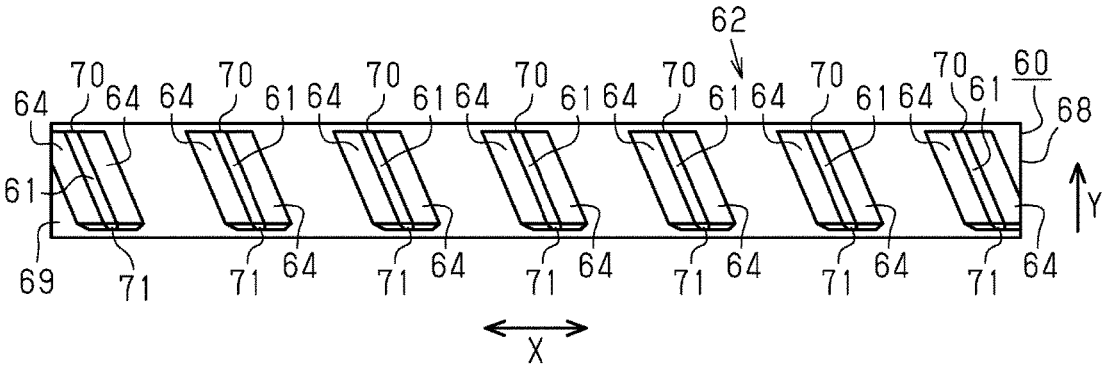
FIG. 32 is a plan view illustrating the supporting portion according to the eleventh embodiment.

As illustrated in FIG. 31 and FIG. 32, the supporting portion 60 of the eleventh embodiment has a plurality of ribs 70 disposed on the upper surface 69 of the base 68. Each of the plurality of ribs 70 extends in a direction intersecting both the width direction X and the transport direction Y of the sheet P (i.e., in an oblique direction). The plurality of the ribs 70 are arranged side by side in the width direction X on the upper surface 69 of the base 68 in such a manner that the ribs 70 extend parallel to each other. Each rib 70 has a supporting surface 61 for supporting the sheet of paper P and slopes 64 inclined from the supporting surface 61 toward the upper surface 69 of the base 68.

When the center line of the rib 70 is taken along the direction of the obliquely-extending rib 70, the slope 64 is provided on the side facing upstream and also on the side facing downstream in the transport direction Y with respect to the center line. In other words, the slope 64 is provided both on the upstream side and on the downstream side of the rib 70 in the transport direction Y. The slope 64 disposed on the upstream side of the rib 70 in the transport direction Y inclines upward from the upstream side toward the downstream side while the slope 64 disposed on the downstream side of the rib 70 inclines downward from the upstream side toward the downstream side.

According to the eleventh embodiment, the effects of (1), (2), (5), (9), and (10) can be obtained.

Note that each of the foregoing embodiments may be modified as below. Moreover, modifications as described below may be appropriately combined.

Figure 33:
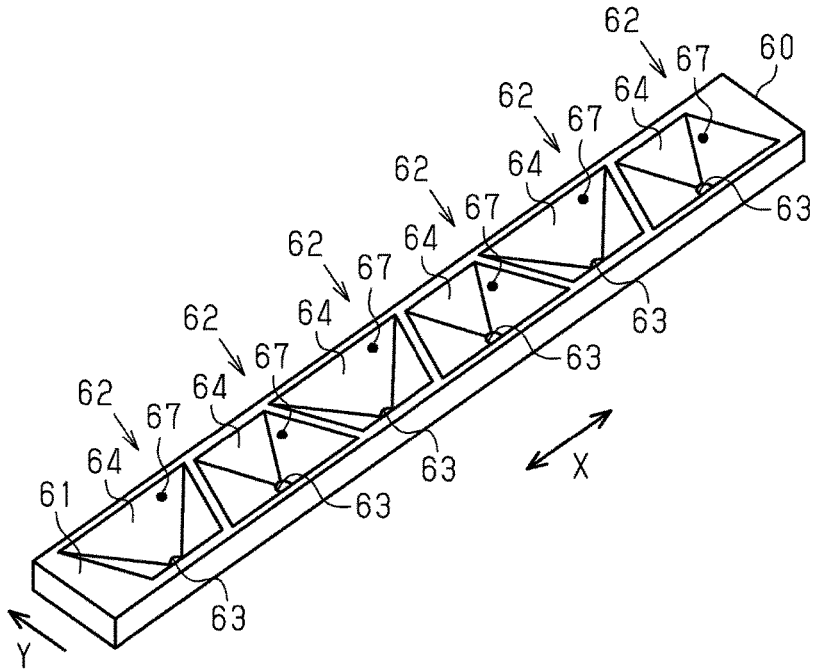
FIG. 33 is a perspective view illustrating a modified example of the supporting portion according to the fourth embodiment.
Figure 34:
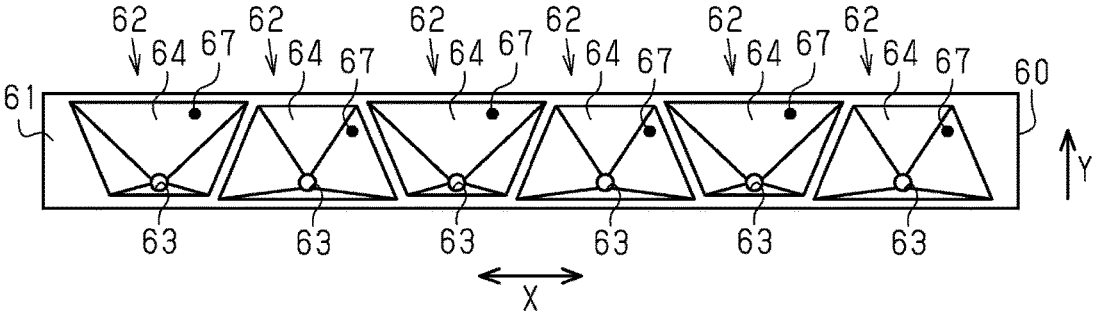
FIG. 34 is a plan view illustrating the modified example of the supporting portion according to the fourth embodiment.
Figure 35:
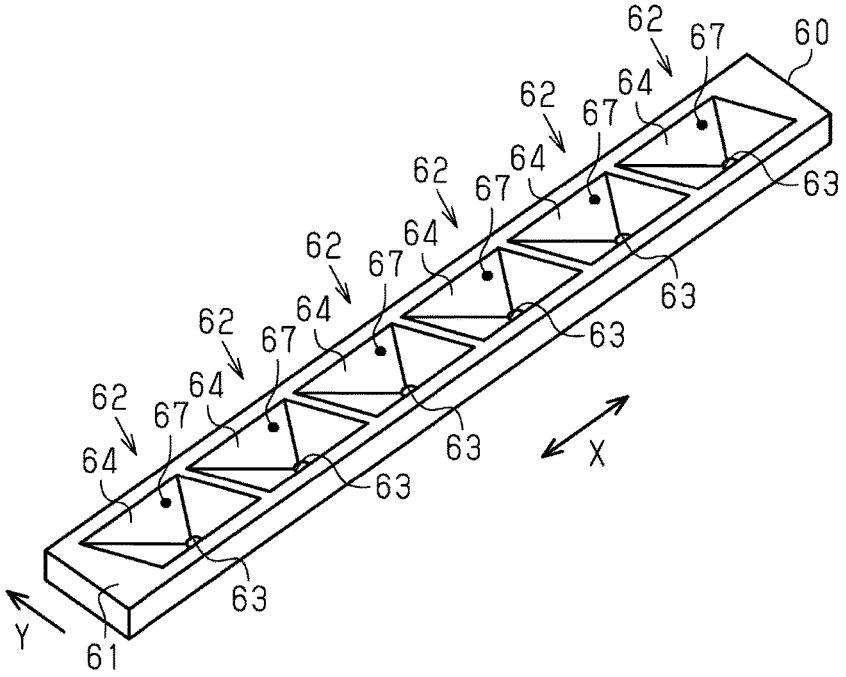
FIG. 35 is a perspective view illustrating a modified example of the supporting portion according to the fifth embodiment.
Figure 36:
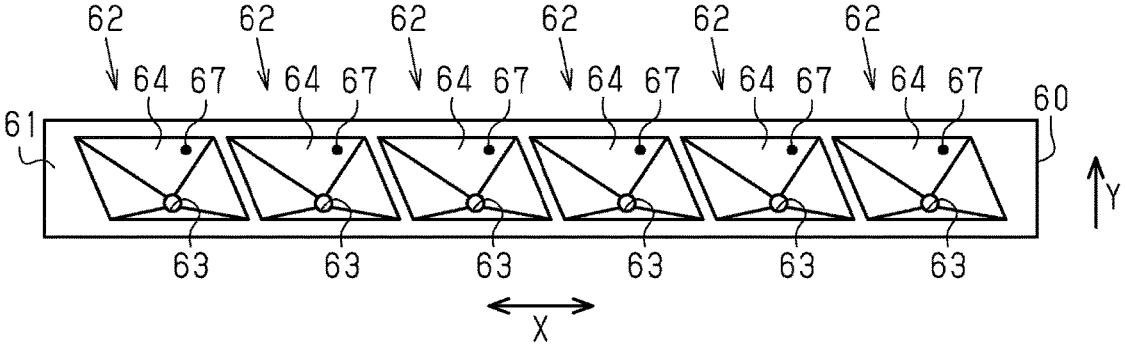
FIG. 36 is a plan view illustrating the modified example of the supporting portion according to the fifth embodiment.

In the fourth embodiment, the position of each through-hole 63 may be changed from the center to a position closer to the upstream side in the transport direction Y, as illustrated in FIG. 33 and FIG. 34. In addition, in the fifth embodiment, the position of each through-hole 63 may be similarly changed to a position slightly closer to the upstream side in the transport direction Y, as illustrated in FIG. 35 and FIG. 36.

According to these modifications, the following effect can be obtained in addition to the effects of (1), (2), (5), and (7):

(11) Each slope 64, which inclines upward from the upstream side toward the downstream side in the transport direction Y, can be formed at a smaller elevation angle, as compared to the configuration in which the through-hole 63 is provided at the center of the dumping portion 62. This can thus reduce the likelihood of the sheet P being caught by the dumping portion 62.

In each of the embodiments, the slope 64 may be configured to be disposed only on the downstream side of the supporting surface 61.

In the second and third embodiments, the groove 65 may be provided in the dumping portion 62.

In the sixth to eleventh embodiments, the through-hole 63 and the slit 66 may be provided in part of the upper surface 69 of the base 68 or the slope 64 that is included in the dumping portion 62.

In each of the embodiments, the container 50 may be replaced with a configuration in which an ink absorbent material is provided in the dumping portion 62.

In each of the embodiments, the medium on which the recording apparatus 11 records is not limited to a sheet of paper P. The medium may include, for example, materials such as cloth and plastic film.

In each of the embodiments, the recording apparatus 11 may be a fluid-ejecting apparatus to record by discharging or ejecting a fluid rather than ink (fluid including liquid, a liquid-state material made by dispersing or mixing particles of a functioning material in liquid, or a fluid-state material such as a gel). For example, the recording apparatus 11 may be a liquid ejecting apparatus that records by ejecting a liquid-state material that contains, in the form of a dispersion or melt, an electrode material, a coloring material (pixel material), etc., to be used for manufacturing liquid crystal displays, Electro Luminescence (EL) displays, surface light emission displays, etc. Moreover, the recording apparatus 11 may be a fluid-ejecting apparatus for ejecting a fluid-state material such as a gel (for example, a physical gel). The invention can be applied to any one of these fluid-ejecting apparatuses. Note that the concept of "fluid" as used herein does not include fluids consisting only of gas, but includes, for example, liquids (including inorganic solvents, organic solvents, solutions, liquid resins, liquid metals (metallic melts), etc.), liquid-state materials, fluid-state materials, and the like.

What is claimed is:

1. A recording apparatus comprising:

a supporting portion that supports a medium transported; and a recording head that is fixedly disposed at a position opposing the supporting portion and that records on the medium by ejecting liquid onto the medium, wherein the recording head has a plurality of nozzle rows each including a plurality of nozzles that eject the liquid, the plurality of nozzle rows are arranged side by side in the recording head along a width direction of the medium that intersects a transport direction of the medium, the supporting portion has a dumping portion including a position opposite the plurality of nozzle rows of the recording head, the dumping portion being capable of receiving the liquid ejected from the nozzle rows when the recording head performs flushing, and a supporting surface capable of supporting the medium at a position not opposite the nozzle rows of the recording head, the dumping portion has a plurality of slopes disposed in at least part of a region adjoining the supporting surface and the slopes inclines relative to the supporting surface, and the plurality of slopes are provided at a position on a downstream side in the dumping portion in the transport direction, and the plurality of slopes are not provided at a position on an upstream side in the dumping portion in the transport direction, wherein the plurality of slopes incline toward a plurality of through-holes, the plurality of slopes being disposed in a manner that matches a staggered pattern of the plurality of nozzle rows such that each slope of the plurality of slopes is disposed in the dumping portion to be opposite to a corresponding nozzle row of the plurality of nozzle rows that is disposed in the recording head.

2. The recording apparatus according to claim 1, wherein the slope is disposed in continuity with the supporting surface and inclined upward from the dumping portion toward the supporting surface.

3. The recording apparatus according to claim 2, wherein the dumping portion has an opening disposed in the supporting surface, the supporting surface being a plane surface.

4. The recording apparatus according to claim 1, further comprising a container for containing the liquid ejected from the nozzle rows when the recording head performs flushing, wherein the dumping portion has a through-hole for allowing the liquid to pass through toward the container.

5. The recording apparatus according to claim 4, wherein the recording head includes a plurality of nozzle groups each having a plurality of the nozzle rows, and the dumping portion is disposed separately at a position opposite each of the nozzle groups.

6. The recording apparatus according to claim 5, wherein the through-hole is provided in the dumping portion at a center thereof both in the transport direction and in the width direction.

7. The recording apparatus according to claim 5, wherein the through-hole is provided at a position closer to an upstream side in the dumping portion in the transport direction and at a center of the dumping portion in the width direction.

8. The recording apparatus according to claim 1, wherein at least the slope has water repellency in the supporting portion.

9. The recording apparatus of claim 1, wherein the recording apparatus further includes a container that is situated below the supporting portion, wherein the container collects the liquid that is received by the dumping portion, and wherein a fan is associated with the container, the fan being usable to draw the liquid into the container.

* * * * *